United States Patent [19]

Arai

[11] 4,250,208

[45] Feb. 10, 1981

[54] METHOD FOR FORMING A TWO-LAYERED CARBIDE SURFACE ON A FERROUS-ALLOY ARTICLE AND RESULTING PRODUCT

[75] Inventor: Tohru Arai, Toyoake, Japan

[73] Assignee: Kabushiki Kaisha Toyota Chuo Kenkyusho, Nagoya, Japan

[21] Appl. No.: 47,919

[22] Filed: Jun. 12, 1979

[30] Foreign Application Priority Data

Jun. 19, 1978 [JP] Japan ..... 53-73922

[51] Int. Cl.[3] ..... C23C 9/10; C23C 11/04

[52] U.S. Cl. ..... 427/249; 427/383.9; 427/399; 427/419.7; 427/431; 148/6.11; 148/6.35

[58] Field of Search ..... 204/37 R; 427/399, 419 F, 427/405, 249, 383 C, 383 D; 148/6.11, 6.35

[56] References Cited

U.S. PATENT DOCUMENTS

| | | | |
|---|---|---|---|
| 2,685,543 | 8/1954 | Sindeband | 427/259 X |
| 3,671,297 | 6/1972 | Komatsu et al. | 427/431 |

*Primary Examiner*—Ralph S. Kendall

*Attorney, Agent, or Firm*—Berman, Aisenberg & Platt

[57] ABSTRACT

A method for forming a two-layered carbide surface on a ferrous-alloy article containing at least 0.2 percent by weight of carbon. The formation of such a surface is effected by plating the ferrous alloy article with chromium, to form a chromium layer thereon, and heating the thus-plated article in contact with an element of Group Va and/or chromium (a) to diffuse carbon from the ferrous-alloy article into the chromium layer and convert the chromium layer to an intermediate chromium-carbide layer and (b) thereafter to combine carbon in the intermediate chromium-carbide layer with the element (of Group Va or chromium) and thus form a Group-Va-element-carbide layer and/or another chromium-carbide layer on the intermediate chromium-carbide layer.

10 Claims, 9 Drawing Figures

(x400)

(x400)

(x400)

(x400)

(x400)

METHOD FOR FORMING A TWO-LAYERED CARBIDE SURFACE ON A FERROUS-ALLOY ARTICLE AND RESULTING PRODUCT

RELATED APPLICATIONS

This application is related to U.S. Pat. No. 3,671,297 (Komatsu, Arai and Mizutani), issued June 20, 1972; U.S. Pat. No. 3,719,518 (Komatsu, Arai and Mizutani), issued Mar. 6, 1973, U.S. Pat. No. 3,874,909 (Arai, Obayashi and Endo), issued Apr. 1, 1975; and U.S. Pat. No. 3,887,443 (Komatsu, Arai and Sugimoto), issued June 3, 1975.

BACKGROUND

Considerable time and energy have been effected to impart corrosion resistance to iron-alloy articles. Moreover, when such articles have been coated to improve corrosion resistance, difficulties have been encountered with spalling.

SUMMARY OF THE INVENTION

Ferrous-alloy articles with a surface comprising two contiguous carbide layers which are metallurgically bonded together and to the ferrous alloy have excellent corrosion and spalling resistance. Such articles are produced by forming an outer carbide layer on an intermediate chromium carbide layer. The outer carbide is a carbide of a Group-Va metal (vanadium, niobium and tantalum) or of chromium, and it is formed with carbon diffused originally from the ferrous-alloy base.

OBJECTS

An object of this invention is to provide an improved method for forming a carbide layer on a ferrous-alloy article. A further object is to impart excellent corrosion resistance to a ferrous-alloy article. Another object is to provide a method for forming a ferrous-alloy article with a two-layered carbide surface comprising an intermediate chromium-carbide layer and an outer layer of a carbide of a Group-Va element or of chromium.

A still further object of this invention is to provide a method for forming a ferrous-alloy article with a two-layered carbide surface in which an intermediate chromium-carbide layer is metallurgically bonded to the ferrous-alloy substrate and to an outer carbide layer of a Group-Va element or of chromium.

Another object is to form on a ferrous-alloy article a two-layered carbide surface which has high mechanical strength and spalling resistance.

An additional object is to provide a ferrous-alloy article with a carbide surface layer which prevents localized corrosion.

A still further object is to provide a ferrous-alloy article with excellent corrosion resistance.

Additional objects are apparent from the description which follows.

DETAILS

Figure 1:
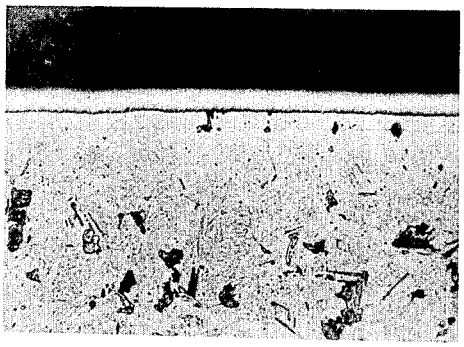
FIGS. 1 to 5 are microphotographs (X 400) of the cross sections of coated layers formed by Examples 1 to 5.

This invention relates to forming a carbide surface on a ferrous-alloy article and to the resulting product, particularly to a method for forming two contiguous carbide layers which impart excellent corrosion resistance to such product.

Carbides of elements of Group Va and chromium carbide have superior wear and corrosion resistance, and the formation of a layer of such carbides on the surface of a ferrous-alloy material is industrially very useful. However, when a ferrous-alloy material having such a surface carbide layer is used, for example, in contact with a molten aluminum bath, localized corrosion occurs in the alloy material during use. After a prolonged period of time, corrosion develops further and attacks the entire material. This is apparently brought about by corrosion of the ferrous-alloy material at defective portions, like fine pores, which are locally present in the coating layer.

According to this invention a two-layered carbide surface, which prevents the occurrence of such localized corrosion, is formed on a ferrous-alloy article.

The present invention provides a method which comprises plating a ferrous-alloy material with chromium to form a chromium layer thereon, and heating the material (bearing the chromium layer) in contact with at least one element of Group Va and/or chromium in order to diffuse carbon of the ferrous-alloy material into the chromium layer and thus convert the chromium layer into an intermediate chromium-carbide layer. Carbon in the intermediate chromium-carbide layer is then combined with the Group-Va element and/or chromium to form an outer Group-Va-element-carbide or chromium-carbide layer on the intermediate chromium-carbide layer.

The two-layered carbide surface obtained by the method of this invention has high mechanical strength and markedly improved spalling resistance because the ferrous-alloy article (substrate) and the intermediate chromium-carbide layer formed thereon are bonded together metallurgically; the intermediate chromium-carbide layer is also metallurgically bonded together with the outer Group-Va-element-carbide or chromium-carbide layer formed thereon. Even when the intermediate chromium-carbide layer and the subsequently-formed Group-Va-element carbide or chromium-carbide layer have localized defects, the chance that localized defects of the two layers might coincide is so remote that the coating layer as a whole is free of defects, and the resulting ferrous-alloy material has excellent corrosion resistance. Hence, this ferrous-alloy material has markedly-increased corrosion resistance over a ferrous-alloy material having only a chromium-plated layer or over a ferrous-alloy material having a carbide layer directly coated thereon. The coating layer provided by this invention exhibits the wear resistance which the Group-Va-element carbide or chromium carbide inherently possesses.

The ferrous-alloy material used for this invention contains at least 0.2 percent by weight of carbon. When a ferrous-alloy material with a lower carbon content is employed, a long treating time is required to form a carbide layer having a suitable thickness for practical application.

The method of chromium-plating the ferrous-alloy material is not particularly limited, and conventional techniques, such as electroplating, chemical plating or dry plating, such as vacuum deposition, are employed. It is desirable, however, to form a plated layer having a minimum of defects. When the thickness of the plated layer is too small, the effect of improving corrosion and oxidation resistance is small; when it is too large, the rate of preparing the outer carbide layer (formed on the intermediate layer) is low, thus requiring an extended period of time and reducing operability. The practical range is from about 2 to 90 microns.

On the intermediate layer, a layer of a carbide of at least one element of Group Va, i.e. vanadium (V), niobium (Nb) or tantalum (Ta), or a chromium (Cr) carbide layer is formed. A complex carbide of these is alternatively formed.

The formation of layers is carried out by diffusing carbon in the ferrous-alloy material into the chromium-plated layer to convert the latter into an intermediate chromium-carbide layer; thereafter, the Group-Va element or chromium (supplied by diffusion from outside) is combined with carbon in the chromium-carbide layer to form an outer layer of a carbide of the Group-Va element or an outer layer of chromium carbide on the intermediate chromium-carbide layer. Specific means for forming the (intermediate and outer) layer include any of (a) a molten-salt-bath method, (b) an electrolytic method using a molten salt bath, (c) a powder method and d) a vapor-phase method (chemical vapor deposition-C.V.D.).

The molten-salt-bath method, which comprises dipping and holding the material to be treated in a boric acid or borate bath (e.g. sodium borate, potassium borate or a mixture thereof) containing the Group-Va element or chromium, is very effective (see U.S. Pat. Nos. 3,719,518 and 3,671,297). In order to shorten the treating time, the material to be treated is effectively dipped and held in the aforesaid treating bath and subjected to an electrolytic treatment; for such purpose the material is employed as a cathode, and a conductive material (separately inserted into the bath), as an anode (see U.S. Pat. No. 3,887,443).

The powder method comprises embedding the material to be treated in a mixture of a powder of fluoborate, such as potassium fluoborate ($KBF_4$), sodium fluoborate ($NaBF_4$) and ammonium fluoborate, and a powder of a Group-Va element and/or a chromium powder, and then heating it (see U.S. Pat. No. 3,874,909).

According to the vapor-phase method an article of a ferrous alloy is heated in an atmosphere which includes at least one halide of at least one of the metals, vanadium, niobium, tantalum and chromium. When, e.g., vanadium halide is the halide, the ferrous-alloy article is heated in, e.g., vanadium chloride vapor, vanadium deposits on the surface of the article during the heating, and the thus-deposited vanadium forms a carbide, i.e. vanadium carbide, (with carbon diffused from the ferrous alloy) on the surface of the article.

In each case, the chromium-plated layer is converted to an intermediate chromium-carbide layer by diffusion of carbon from the ferrous-alloy material, and an outer layer of a carbide of the Group-Va element and/or of chromium is formed on the intermediate chromium-carbide layer by the combination of carbon from the intermediate carbide layer with the Group-Va element and/or chromium.

The treating temperature is, e.g., from 700° C. to a point below the melting point of the ferrous-alloy material; however, in view of the rate of formation of the carbide layer; the degradation of the material by high temperatures, etc., the practical treating-temperature range is from 800° to 1,100° C. The treating time depends upon the required or desired thickness of the coating (intermediate and outer) layer and the treating temperature; generally, a period of from about 1 hour to 30 hours is suitable.

A suitable thickness of the outer layer of a carbide of the Group-Va element and/or chromium is from about 2 to about 20 microns ($\mu$). If it is less than 2 microns, the improved corrosion resistance is not assured; if it is larger than 20 microns, the formed layer tends to peel off.

EXAMPLE 1

(1) Many test pieces of JIS SK4 (Japan Industrial Standards—carbon tool steel generally comprising 0.90 to 1.00 percent by weight of carbon) and SKD11 (alloy tool steel generally comprising from 1.40 to 1.60 percent by weight of carbon, from 11 to 13 percent by weight of chromium, from 0.80 to 1.02 percent by weight of molybdenum and from 0.20 to 0.50 percent by weight of vanadium), 8 mm in diameter and 40 mm in length, were electroplated with chromium. The thickness of each plated layer was substantially uniform, but the different plated layers varied between 9 and 88 microns in thickness.

Each of the test pieces was immersed in a molten borax bath (kept at 1,000° C. and at ambient atmosphere) containing 20 percent by weight, based on the entire amount of the bath, of ferro-vanadium (Fe-52% by weight of V) powder for 8 hours and for 16 hours, respectively, for the JIS SK4 and SKD11 and then withdrawn. Each thus-treated product was oil quenched and subsequently washed with warm water to remove adhering treating agent.

The cross-sectional structures of the treated test pieces were observed. Two layers were formed on all test pieces. FIG. 1 is a microphotograph of the cross section of an SK4 test piece which was plated with chromium to a thickness of 15 microns and then treated for 8 hours to form a two-layered carbide surface.

Figure 6:
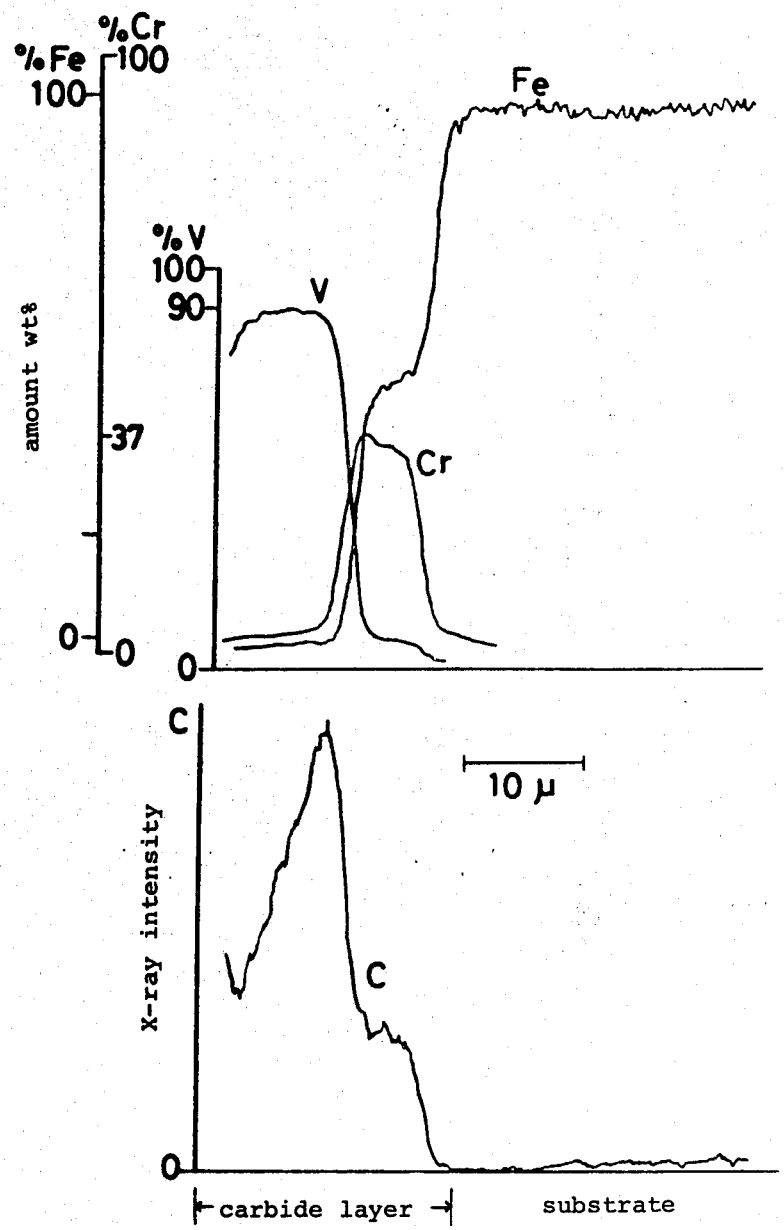
FIG. 6 is a diagram which reflects the results of an electron-probe microanalysis of the coated layer formed by Example 1.

The test piece shown in FIG. 1 was subjected to analysis by an electron-probe microanalyzer. The results led to confirmation that, as shown in FIG. 6, the outer layer was composed of V and C, and the intermediate layer was composed of Cr, Fe and C. The X-ray diffraction pattern for the outer layer corresponded to that for VC.

By measurement, the outer layer was found to have a Vicker's hardness of 3000, and the intermediate layer, a Vicker's hardness of 1600. The hardness of the outer layer is the same as that of a VC layer formed by similarly treating an SK4 or SKD11 test piece (having no intermediate chromium-plated layer) in the same borax bath as described above. The hardness of the intermediate layer was likewise the same as that of chromium carbide ($Cr_7C_3+Cr_{23}C_6$) formed by treating an SK4 or SKD11 test piece (having no chromium-plated layer) in a molten borax bath containing chromium powder.

It is thus noted that, at the treating temperature, chromium atoms of the plated layer react with carbon atoms of the substrate (ferrous alloy) to gradually convert the chromium-plated layer (on the side of the substrate) to an intermediate chromium-carbide layer, (while the surface portion of the chromium-plated layer gradually dissolves into the molten bath; then by combining carbon atoms in the resultant intermediate chromium-carbide layer with vanadium atoms in the bath, the outer VC layer was formed.

Figure 7:
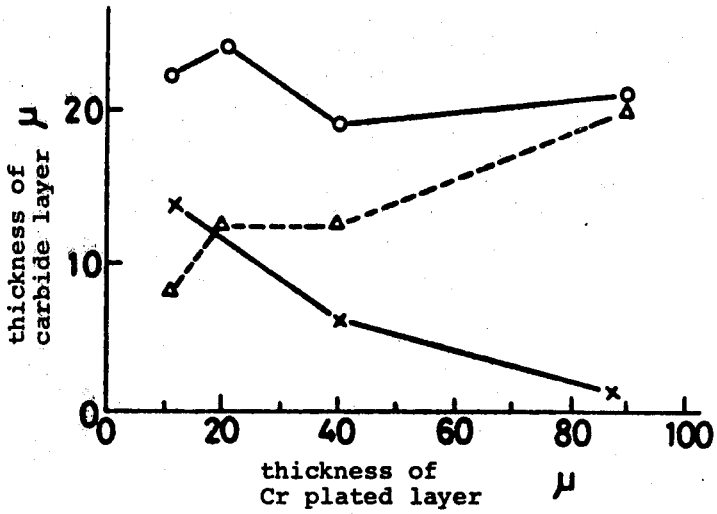
FIG. 7 is a diagram showing the thickness of individual layers forming the coated layer produced by Example 1.

FIG. 7 shows the relation between the thickness of the chromium-plated layer formed by plating and the thickness of the carbide layer formed by the treatment (for 8 hours) in accordance with this invention. In the drawing, the abscissa represents the thickness of the chromium-plated layer, and the ordinate, the thickness of the carbide layer. The symbol represents the entire carbide layer composed of an intermediate layer and an outer layer; the symbol Δ, the intermediate carbide layer; and the symbol X, the outer carbide layer.

FIG. 7 shows that, with increasing thickness of the chromium-plated layer, the thickness of the intermediate layer increases, and the thickness of the outer layer decreases. However, the thickness of the carbide layer as a whole is not affected by thickness of the chromium-plated layer; it remains constant at about 20 microns.

(2) The resulting coated ferrous-alloy materials were each subjected to a hammering test and a coining test to confirm the adhesion strength of the carbide layer.

The hammering test comprises repeated striking of the same part of the surface of a test specimen at a speed of 0.2 m/sec. by a hammer having a weight of 0.42 kg and a hemispherical sharpened head having a radius of 3.2 mm. The test piece used was one obtained by this Example and consisting of an SKD11 (10×10×50 mm) test piece having on its surface an intermediate 3-micron-thick chromium-carbide layer and an outer 13-micron-thick vanadium-carbide layer. Even after hammering more than 200,000 times in this hammering test, peeling of the coating (intermediate and/or outer) layer was not noted. In a test piece having only a chromium-plated layer, peeling visible to the naked eye occurred after hammering 50,000 times.

In a coining test, spalling resistance was evaluated by using a punch for press forming adapted to collapse a 1.8 mm-thick mild steel sheet to a thickness of 0.9 mm. The coining test was performed by using the same kind of test piece as used in the hammering test in this Example. When punching was performed through about 20,000 shots, no peeling of either the intermediate or outer carbide layer was noted. When corresponding test pieces with only a chromium-plated layer were similarly treated, the layer peeled off after 6,000 shots.

(3) To examine the corrosion resistance of text pieces obtained by this Example, two dipping tests were performed. The first was in molten aluminum (JIS AC8B-comprising 2 to 4 percent by weight of copper, 8.5 to 10.5 percent by weight of silicon, 0.5 to 1.5 percent by weight of magnesium and 0.5 to 1.5 percent by weight of nickel, the balance being aluminum), and the second was in 36 percent aqueous hydrochloric acid. In the first test the aluminum was heated to 700° C. in a graphite crucible and melted.

The test pieces (10×10×50 mm) consisted of SKD11 having a carbide surface (a 3-micron-thick chromium-carbide intermediate layer and a 13-micron-thick vanadium-carbide outer layer). For comparison, two test pieces (a test piece consisting of SKD11 with a 9-micron-thick chromium-plated layer formed on it and a test piece obtained by forming an 8-micron-thick vanadium-carbide layer directly on the surface of SKD11 without chromium plating) were used.

In the dipping test in molten aluminum, more than half of the surface area of the comparative test piece having only the chromium-plated layer was heavily corroded in only 2 hours, and more than half of the surface area of the comparative test piece having only the vanadium-carbide layer was heavily corroded in 64 hours. In contrast, the test pieces obtained by the present Example were found to be only slightly corroded even after dipping for 128 hours.

In the dipping test in aqueous hydrochloric acid solution, the comparative test piece having the chromium-plated layer and the comparative test piece having only the vanadium-carbide layer, after dipping for 5 hours, reflected localized corrosion at 20 sites and entire corrosion, respectively. However, the test pieces obtained by this Example were found to be quite free from corrosion after dipping for 50 hours; after dipping for 100 hours, slight localized corrosion was noted only at two sites.

EXAMPLE 2

(1) Test pieces, 8 mm in diameter and 40 mm in length, were prepared from two materials, SK4 and SKD11. A 9-micron-thick or 15-micron-thick chromium-plated layer was formed on each of the test pieces by the same method as described in Example 1. Each of the test specimens was dipped and held for 8 hours in a molten borax bath containing 15 percent by weight of chromium powder. The bath temperature was adjusted to 900° C. for the test pieces made of SK4 and to 1,000° C. for the test pieces made of SKD11.

Figure 2:
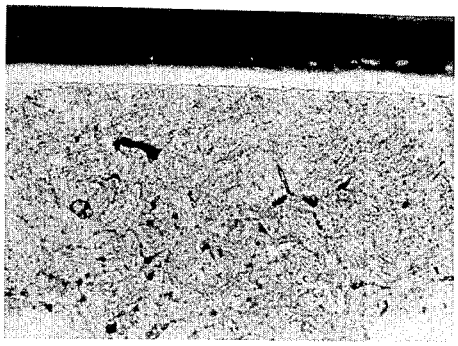

A coated (intermediate and outer) layer having a thickness of from 8 to 10 microns was thus formed on each of the test pieces. A microphotograph of the cross section of a typical test piece is shown in FIG. 2. The thickness of the resulting layer is in a reverse relation to the thickness of the chromium-plated layer; irrespective of the type of starting material, a coated layer having an overall thickness of about 8 microns was formed on the test pieces which had a 15-micron-thick chromium-plated layer, and a coated layer having a thickness of about 10 microns was formed on the test pieces which had a 9-micron-thick chromium-plated layer.

Figure 8:
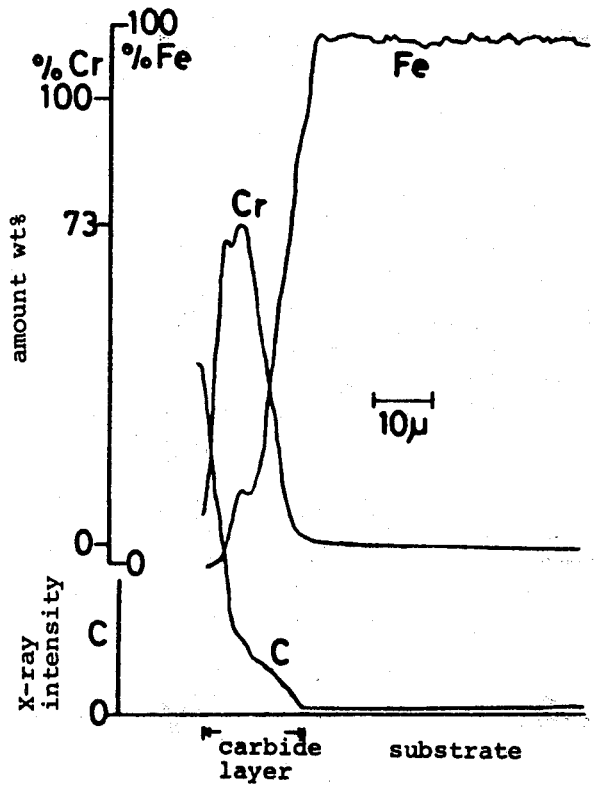
FIG. 8 is a diagram which reflects the results of an electron-probe microanalysis of the coated layer formed by Example 2.

A microscopic observation of the cross section of the coated layer clearly showed a difference from the chromium-plated layer. Analysis on an electron-probe microanalyzer confirmed that this layer was a chromium-carbide layer. The analytical results from the electron-probe microanalyzer are shown in FIG. 8.

It was not clear from the microscopic examination of the cross section and the analysis for the electron-probe microanalyzer whether the resulting coating layer was a chromium-carbide layer resulting from converting the chromium-plated layer or whether a chromium-carbide layer formed by chromium in the bath and carbon in the treated material lay over the chromium-carbide layer resulting from the change of the chromium-plated layer. However, when a weight change before and after the heat-dipping treatment was examined, the test pieces which had a 9 micron-thick chromium plated layer were found to show a weight increase of 0.8 mg/cm$^2$. This made it substantially clear that the resulting coated layer consisted of an intermediate chromium-carbide layer formed by converting the chromium-plated layer and a new outer chromium-carbide layer superimposed on it.

(2) To examine the effect of corrosion resistance, a corrosion test in a 36 percent aqueous HCl solution was performed in the same way as in Example 1.

In the comparative test piece composed of SK4 with only a 9-micron-thick chromium-plated layer formed thereon, localized corrosion was seen at 20 sites after dipping for 5 hours. However, in the test pieces having superimposed chromium-carbide layers with a thickness of about 10 microns obtained by this Example, localized corrosion was seen only at two sites after dipping for 50 hours and only at three sites after dipping for 100 hours. Thus, the improvement of corrosion resistance was confirmed.

EXAMPLE 3

Many tests pieces (8 mm in diameter and 40 mm in length) were prepared from JIS SK4 steel material. By the same method as described in Example 1, a chromium-plated layer (having a substantially-uniform thickness ranging from 9 to 88 microns) was formed on these test pieces.

Each of these test pieces was dipped in a molten borax bath (kept at 1,000° C.) containing 20 percent by weight of ferro-niobium (Fe-55% by weight of Nb) powder and treated therein for 8 hours.

Figure 3:
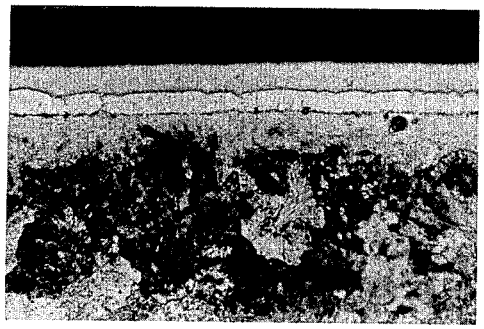

As a result of this treatment, a coated layer (seen as two layers by microscopic examination of its cross section) was formed on all of the test pieces. FIG. 3 shows a microphotograph of the cross section of a test piece which had a 13-micron-thick chromium-plated layer and which was subjected to the aforesaid heat-dipping treatment. When the cross section of the coating layer was examined by X-ray diffraction and an electron-probe microanalyzer, it was confirmed that the intermediate layer of the coated layer was chromium carbide and the outer layer was niobium carbide.

Figure 9:
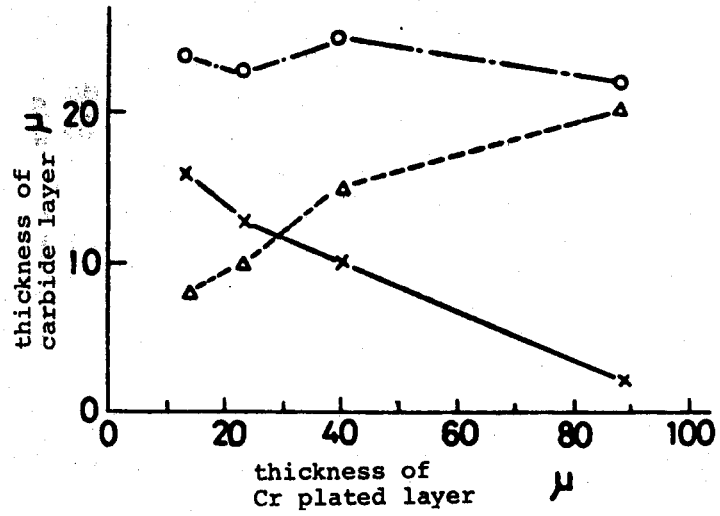
FIG. 9 is a diagram showing the thickness of the individual layers constituting the coated layer formed by Example 3.

FIG. 9 shows the thickness of the chromium-plated layer formed in the first step, the thickness of the entire (composite) coated layer after the heat-dipping treatment (for 8 hours), and the thicknesses of the outer and intermediate layers. In the drawing, the abscissa represents the thickness of the chromium-plated layer, and the ordinate, the thickness of the resulting carbide layer. In the drawing, the symbol represents the thickness of the entire carbide layer; symbol Δ, the thickness of the intermediate chromium-carbide layer; and symbol X, the thickness of the outer niobium-carbide layer.

EXAMPLE 4

A test piece, 8 mm in diameter and 60 mm in thickness, was prepared from a JIS SK4 material. The surface of this test piece was electroplated to form a chromium-plated layer having a thickness of 13 microns. The test piece was then dipped to a depth of only 50 mm into the center of a molten borax bath (in a graphite vessel) containing 20 percent by weight of a ferro-vanadium (Fe-52% by weight of V) powder and subjected to electrolysis treatment for 4 hours at a cathode-current density of 0.01 $A/cm^2$ (using the graphite vessel as an anode and the test piece as a cathode). The test piece was then taken out of the bath, and oil quenched.

Figure 4:
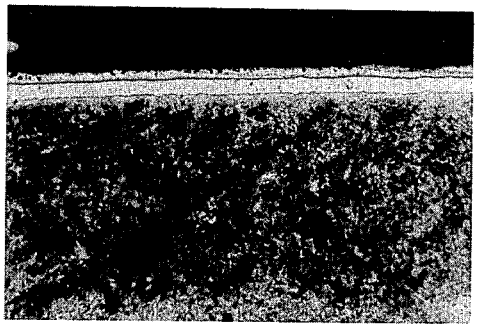

This treatment resulted in the formation of a coated layer consisting of a 7-micron-thick intermediate layer of chromium carbide and a 5-micron-thick outer layer of vanadium carbide. A microphotograph of its cross section is shown in FIG. 4.

EXAMPLE 5

Test pieces (8 mm in diameter and 60 mm in length) were prepared from JIS SK4 material and electroplated to form thereon a chromium-plated layer having a thickness of 13 microns. Two heat-resistant steel vessels (110 mm in diameter and 100 mm in height) were prepared. A mixture of 90 percent by weight of Fe-(52% by weight of)V powder and 10 percent by weight of $KBF_4$ powder was charged into one of them; a mixture of 90 percent by weight of Fe-(55% by weight of)Nb powder and 10 percent by weight of $KBF_4$ powder, into the other. One test piece was embedded in powder in each of the vessels. These vessels were sequentially placed in an electric furnace, heated at 1,000° C. for 4 hours, taken out of the furnace and cooled with air. After cooling, the test pieces were taken out of the vessels and examined.

On the test piece treated with the mixed powder of Fe-V and $KBF_4$, a coated layer was formed which consisted of an intermediate layer of chromium carbide having a thickness of about 10 microns and an outer layer of vanadium carbide having a thickness of about 5 microns. On the test piece treated with the mixed powder of Fe-Nb and $KBF_4$, a coated layer was formed which consisted of an intermediate layer of chromium carbide having a thickness of about 10 microns and an outer niobium-carbide layer having a thickness of about 3 microns.

Figure 5:
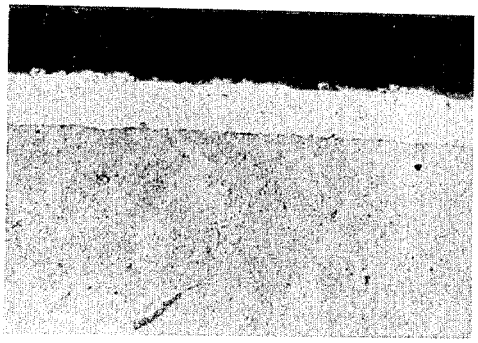

A microphotograph of the cross section of the coated layer (intermediate and outer layers) in the test piece treated with the mixed powder of Fe-V and $KBF_4$ is shown in FIG. 5.

The invention and its advantages are readily understood from the preceding description. It is apparent that various changes may be made in the starting materials, the process and the resulting products without departing from the spirit and scope of the invention or sacrificing its material advantages. The hereinbefore-described process and products are merely illustrative of preferred embodiments of the invention.

What is claimed is:

1. A method for forming a two-layered carbide surface on a ferrous-alloy article containing at least 0.2 percent by weight of carbon which comprises the steps of plating the surface of the ferrous-alloy article with chromium to form a chromium-plated layer thereon, and heating the resulting plated article in a medium containing at least one element selected from the group consisting of Group-Va elements and chromium to diffuse carbon from the ferrous-alloy article into the chromium-plated layer and thus convert said chromium-plated layer into an intermediate chromium-carbide layer, and thereafter to combine diffused carbon in the intermediate chromium-carbide layer with the element to form an outer carbide layer on the intermediate chromium-carbide layer.

2. A method according to claim 1 wherein the thickness of said chromium-plated layer is within a range of from about $2\mu$ to $90\mu$.

3. A method according to claim 1 wherein the heating is carried out for from 1 to 30 hours at a temperature within a range of from 700° C. to a point below the melting point of the ferrous-alloy article.

4. A method according to claim 3 wherein the temperature range is from 800° C. to 1,100° C.

5. A method according to claim 1 wherein the plated article is heated in a molten treating bath composed of molten boric acid or borate and at least one element selected from the group consisting of Group-Va elements and chromium and held in the bath for enough time to form the two-layered carbide surface.

6. A method according to claim 5 wherein the borate is a member selected from the group consisting of sodium borate, potassium borate and a mixture thereof.

7. A method according to claim 5 wherein electricity is applied to the plated article, which is used as a cathode, while said article is immersed in the molten bath.

8. A method according to claim 1 wherein the plated article is heated in a powder mixture of fluoborate and at least one element selected from the group consisting of Group-Va elements and chromium and maintained in said powder mixture for enough time to form the two-layered carbide surface.

9. A method according to claim 1 wherein the plated article is heated in a gas comprising at least one gaseous element selected from the group consisting of Group-Va elements and chromium.

10. A method according to claim 1 wherein the thickness of the outer carbide layer is within a range of from about 2 to 20$\mu$.

* * * * *